United States Patent [19]

Rosado

[11] 4,018,124

[45] Apr. 19, 1977

[54] AUTOMATIC GUITAR TUNER FOR ELECTRIC GUITARS

[76] Inventor: Ruperto L. Rosado, 2231 Nothrop Ave., Sacramento, Calif. 95825

[22] Filed: Nov. 26, 1975

[21] Appl. No.: 635,766

[52] U.S. Cl. ..... 84/1.16; 84/454

[51] Int. Cl.[2] ..... G10D 5/00

[58] Field of Search ..... 84/454–456, 84/1.01, 1.16; 324/79 R

[56] References Cited

UNITED STATES PATENTS

| | | | |
|---|---|---|---|
| 3,722,353 | 3/1973 | Westhauer | 84/454 |
| 3,766,818 | 10/1973 | Proltofskt | 84/454 |
| 3,861,266 | 1/1975 | Whitaker | 84/1.01 |
| 3,881,389 | 5/1975 | Allen | 84/454 |
| 3,896,697 | 7/1975 | Iannone | 84/1.16 |
| 3,901,120 | 8/1975 | Youngquist | 84/454 |
| 3,948,140 | 4/1976 | Ichioka et al. | 84/454 |

*Primary Examiner*—Robert K. Schaefer
*Assistant Examiner*—Vit W. Miska
*Attorney, Agent, or Firm*—Blair & Brown

[57] ABSTRACT

An automatic guitar tuner for a standard six string electric guitar which includes a pick-up, a master crystal oscillator, and a tone generator for each string of the guitar. The pick-up feeds a frequency comparator for each string of the guitar and each frequency comparator is fed by a separate tone generator. A light emitting diode is positioned under each of the strings of the guitar and is connected between the frequency comparator and a source of electricity, either battery or transformer. When the frequency of the individual tone generator and the frequency of the string match, the frequency comparator will complete a circuit through the light emitting diode so that the light emitting diode indicates that the individual string is properly tuned. When the string is out of tune it is adjusted in the normal fashion until the light emitting diode associated therewith is energized.

4 Claims, 4 Drawing Figures

AUTOMATIC GUITAR TUNER FOR ELECTRIC GUITARS

BACKGROUND OF THE INVENTION

FIELD OF THE INVENTION

The present invention relates to automatic tune indicators for an electric guitar.

SUMMARY OF THE INVENTION

The tune indicator of an electric guitar according to the present invention includes a light emitting diode under each string of the guitar and means for comparing the frequency of the vibrations of the string with a standard frequency to energize the light emitting diode when the string frequency and the standard frequency match.

The primary object of the invention is to provide a continuous in tune comparator system which will immediately indicate when a string is out of tune.

Other objects and advantages will become apparent in the following specification when considered in light of the attached drawings.

DESCRIPTION OF THE PREFERRED EMBODIMENT

Figure 1:
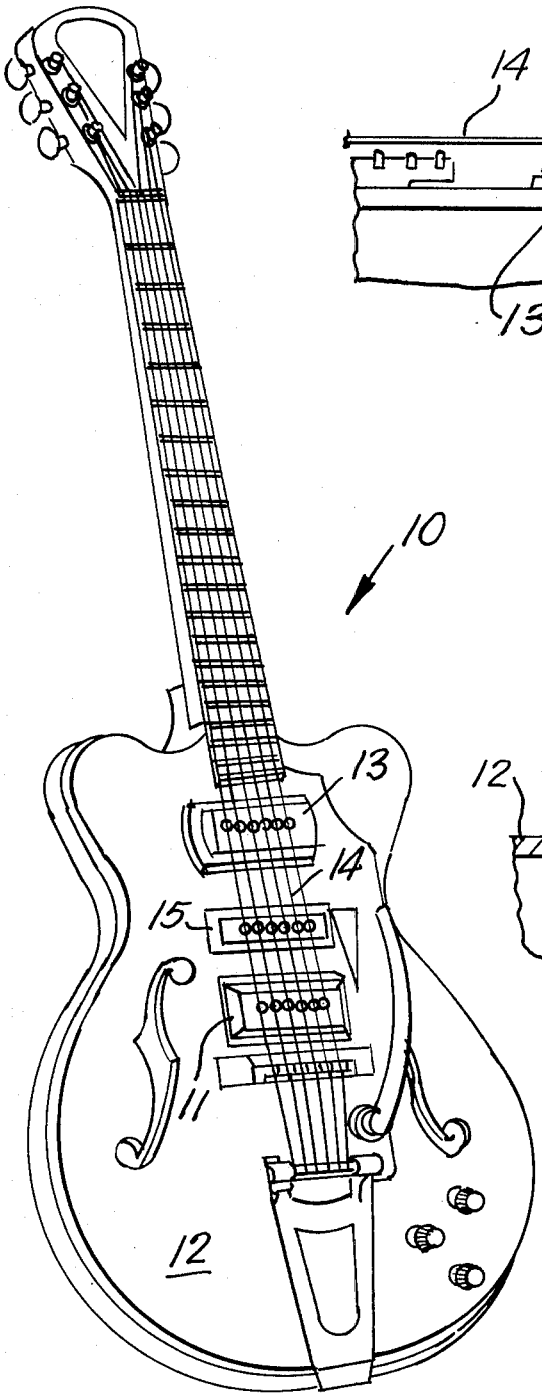
FIG. 1 is a perspective view of a guitar constructed in accordance with the invention.
Figure 2:
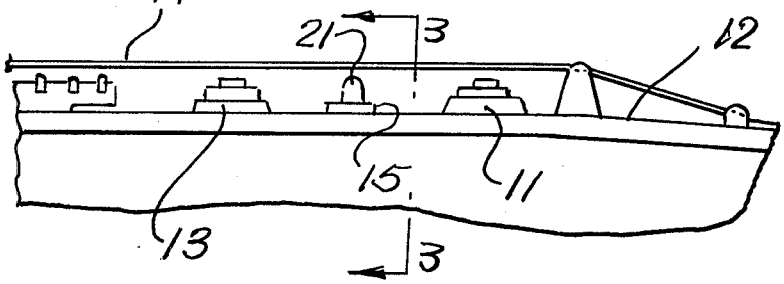
FIG. 2 is an enlarged fragmentary side elevation of the guitar of FIG. 1.
Figure 3:
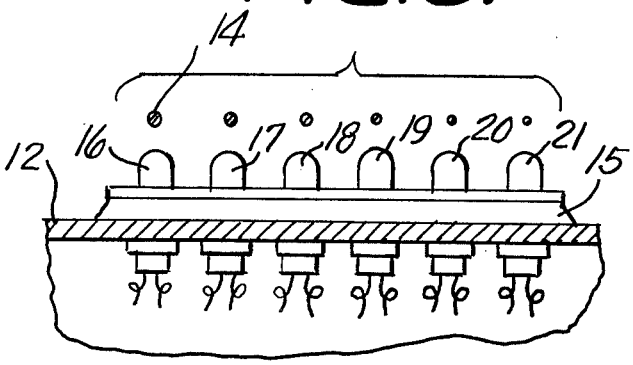
FIG. 3 is an enlarged fragmentary transverse sectional view taken along the line 3—3 of FIG. 2 looking in the direction of the arrows.

Referring now to the drawings in detail wherein like reference characters indicate like parts throughout the several figures the reference numeral 10 indicates generally an electric guitar constructed in accordance with the invention.

The electric guitar 10 is of conventional structure and has a pick-up 11 on the upper side 12 thereof to feed the ordinary amplification and speaker system associated with the electric guitar 10.

A second pick-up 13 is also mounted on the upper surface 12 of the guitar 10 beneath the strings 14 for reasons to be assigned.

A base 15 is secured to the upper surface 12 of the guitar 10 and has a plurality of light emitting diodes 16, 17, 18, 19, 20 and 21. The diodes 16 through 21 each underlie one of the strings 14 of the guitar 10.

Figure 4:
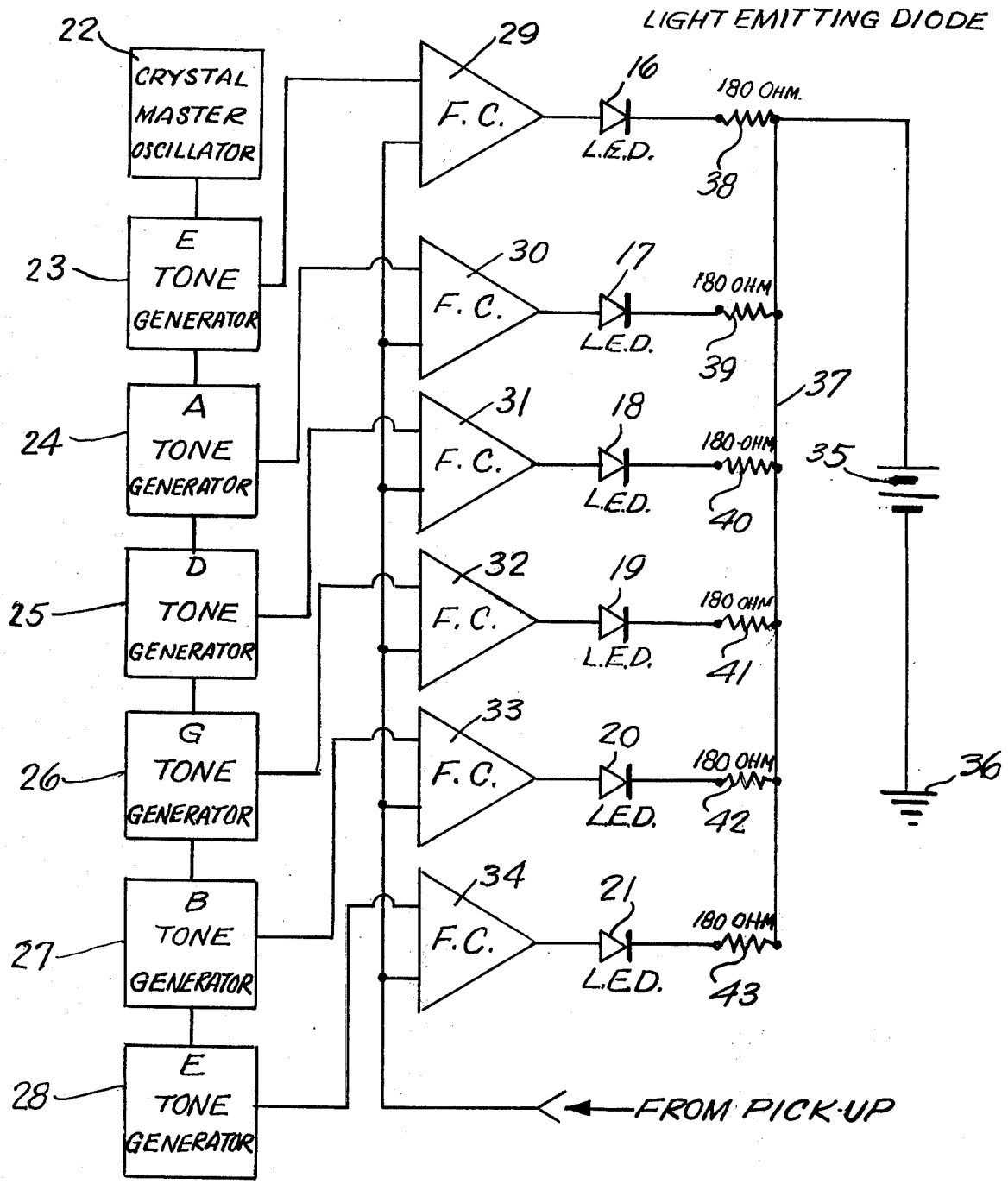
FIG. 4 is a circuit diagram of the circuits involved with the invention.

Referring now to FIG. 4 a master crystal oscillator 22 is electrically connected to an E tone generator 23, an A tone generator 24, a D tone generator 25, a G tone generator 26, a B tone generator 27, and an E tone generator 28. The E tone generator 23 is electrically connected to the frequency comparator 29. The A tone generator 24 is electrically connected to the frequency comparator 30. The D tone generator 25 is electrically connected to the frequency comparator 31. The G tone generator 26 is electrically connected to the frequency comparator 32. The B tone generator 27 is electrically connected to the frequency comparator 33. The E tone generator 28 is electrically connected to the frequency comparator 34. The frequency comparator 29 is electrically connected to the light emitting diode 16. The frequency comparator 30 is electrically connected to the light emitting diode 17. The frequency comparator 31 is electrically connected to the light emitting diode 18. The frequency comparator 32 is electrically connected to the light emitting diode 19. The frequency comparator 33 is electrically connected to the light emitting diode 20. The frequency comparator 34 is electrically connected to the light emitting diode 21. The pick-up 13 is electrically connected to each of the frequency comparators 29 through 34. A battery 35, which may be an electrical transformer if desired, is connected on one side to ground 36 and on the opposite side to a common line 37 which is electrically connected to a plurality of 180 ohm resistors 38, 39, 40, 41, 42, and 43. The resistor 38 is electrically connected to the light emitting diode 16. The resistor 39 is electrically connected to the light emitting diode 17. The resistor 40 is electrically connected to the light emitting diode 18. The resistor 41 is electrically connected to the light emitting diode 19. The resistor 42 is electrically connected to the light emitting diode 20. The resistor 43 is electrically connected to the light emitting diode 21.

In the use and operation of the invention a conventional master crystal oscillator proivdes a frequency which is fed to the tone generators 23 through 28 and this frequency is in turn shifted by the tone generators 23–28 to provide the correct frequency for each of the strings 14 of the guitar 10. The output of the tone generators 23 through 28 are separately fed through the frequency comparators 29 through 34 respectively and these signals are compared to the signals fed from the pick-up 13.

When the signal from the pick-up 13 fed to the frequency comparator 29 matches the E tone generator 23 signal the light emitting diode 16 is lit showing the reflective string 14 to be in tune. Similarly, the tones from tone generators 24 through 28 are compared in frequency comparators 30–34 to light the light emitting diodes 17 through 21 respectively when the strings 14 are each in tune.

In the event that any one of the strings 14 goes out of tune its respective diode 16 through 21 will be dark indicating the need for adjusting the tension on the string 14. When the tension on the string 14 is properly adjusted the respective light emitting diode will be lit and when all of the diodes 16 through 21 are lit the guitar is in tune.

Having thus described the preferred embodiment of the invention it should be understood that numerous structural modifications and adaptations may be resorted to without departing from the spirit of the invention.

What is claimed is:

1. An electric guitar attachment for tuning the guitar comprising a plurality of standard tone generators for generating the correct tone frequency desired to the guitar strings, a light emitting diode positioned beneath each of the strings of the guitar, a pick-up mounted beneath each of the strings of the guitar, a plurality of frequency comparators mounted within the guitar and electrically connected respectively to said tone generators and to said light emitting diodes, means electrically connecting a respective one of said tone generators and a respective one of said light emitting diodes to said frequency comparator to illuminate said light emitting diodes upon matching of frequencies in each of said frequency comparators.

2. A device as claimed in claim 1 wherein a battery is provided for energizing said light emitting diodes.

3. A device as claimed in claim 1 wherein a transformer is provided for energizing said light emitting diodes.

4. A device as claimed in claim 1 wherein a master crystal oscillator is electrically connected to each of said tone generators for providing a master frequency to be individually adjusted by said tone generators.

* * * * *